US007950198B2

(12) United States Patent
Pilz et al.

(10) Patent No.: US 7,950,198 B2
(45) Date of Patent: May 31, 2011

(54) FIRE-RATED WALL CONSTRUCTION PRODUCT

(75) Inventors: Don A. Pilz, Livermore, CA (US); Raymond E. Poliquin, City of Industry, CA (US); Fernando Hernandez Sesma, City of Industry, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 9 days.

(21) Appl. No.: 12/620,459

(22) Filed: Nov. 17, 2009

(65) Prior Publication Data

US 2010/0126092 A1 May 27, 2010

Related U.S. Application Data

(62) Division of application No. 12/013,361, filed on Jan. 11, 2008, now Pat. No. 7,617,643.

(60) Provisional application No. 60/957,434, filed on Aug. 22, 2007.

(51) Int. Cl.
*E04C 2/00* (2006.01)

(52) U.S. Cl. ..... 52/232; 52/1; 52/741.3; 52/302.1; 52/302.3; 52/302.5; 52/198; 52/199; 454/258

(58) Field of Classification Search ..... 52/46, 232, 52/1, 241, 481.1, 481.2, 741.3, 846, 302.1, 52/302.3, 302.5, 95, 198, 199; 454/258, 454/254

See application file for complete search history.

(56) References Cited

U.S. PATENT DOCUMENTS

| | | | |
|---|---|---|---|
| 2,218,426 | A | 10/1940 | Hulbert, Jr. |
| 2,683,927 | A | 7/1954 | Maronek |
| 2,733,786 | A | 2/1956 | Drake |
| 3,129,792 | A | 4/1964 | Gwynne |
| 3,324,615 | A | 6/1967 | Zinn |
| 3,397,495 | A | 8/1968 | Thompson |
| 3,481,090 | A | 12/1969 | Lizee |
| 3,537,219 | A | 11/1970 | Navarre |
| 3,566,559 | A | 3/1971 | Dickson |
| 3,744,199 | A | 7/1973 | Navarre |
| 3,839,839 | A | 10/1974 | Tillisch et al. |

(Continued)

FOREIGN PATENT DOCUMENTS

| | | |
|---|---|---|
| CA | 2234347 | 10/1999 |

(Continued)

OTHER PUBLICATIONS

Catalog page from Stockton Products, printed from www.stocktonproducts.com, on Dec. 16, 2007, showing #5 Drip, in 1 page.

(Continued)

*Primary Examiner* — Robert J Canfield
*Assistant Examiner* — Matthew J. Gitlin
(74) *Attorney, Agent, or Firm* — Knobbe, Martens, Olson & Bear, LLP

(57) ABSTRACT

The present invention is directed toward fire-rated wall construction components for use in building construction. The invention provides wall components and systems which have fire-retardant characteristics, as well as wall components which allow for needed ventilation in a building throughout times when no fire is present. Embodiments include tracks for holding studs which incorporate various geometries capable of receiving intumescent material. When the intumescent material becomes hot, it expands rapidly and fills its surrounding area, blocking fire, heat, and smoke from traveling to other areas of a building.

16 Claims, 5 Drawing Sheets

U.S. PATENT DOCUMENTS

| | | | | |
|---|---|---|---|---|
| 3,935,681 | A | 2/1976 | Voiturier et al. | |
| 3,955,330 | A | 5/1976 | Wendt | |
| 3,964,214 | A | 6/1976 | Wendt | |
| 4,011,704 | A | 3/1977 | O'Konski | |
| 4,103,463 | A | 8/1978 | Dixon | |
| 4,130,972 | A | 12/1978 | Varlonga | |
| 4,144,335 | A * | 3/1979 | Edwards | 514/79 |
| 4,152,878 | A | 5/1979 | Balinski | |
| 4,164,107 | A | 8/1979 | Kraemling et al. | |
| 4,283,892 | A | 8/1981 | Brown | |
| 4,318,253 | A * | 3/1982 | Wedel | 52/63 |
| 4,329,820 | A | 5/1982 | Wendt | |
| 4,437,274 | A | 3/1984 | Slocum et al. | |
| 4,649,089 | A | 3/1987 | Thwaites | |
| 4,672,785 | A | 6/1987 | Salvo | |
| 4,709,517 | A | 12/1987 | Mitchell et al. | |
| 4,723,385 | A | 2/1988 | Kallstrom | |
| 4,787,767 | A | 11/1988 | Wendt | |
| 4,825,610 | A | 5/1989 | Gasteiger | |
| 4,850,385 | A | 7/1989 | Harbeke | |
| 5,010,702 | A | 4/1991 | Daw et al. | |
| 5,103,589 | A | 4/1992 | Crawford | |
| 5,125,203 | A | 6/1992 | Daw | |
| 5,127,203 | A | 7/1992 | Paquette | |
| 5,127,760 | A | 7/1992 | Brady | |
| 5,146,723 | A | 9/1992 | Greenwood et al. | |
| 5,155,957 | A | 10/1992 | Robertson et al. | |
| 5,157,883 | A | 10/1992 | Meyer | |
| 5,222,335 | A | 6/1993 | Petrecca | |
| 5,285,615 | A | 2/1994 | Gilmour | |
| 5,325,651 | A | 7/1994 | Meyer et al. | |
| 5,367,850 | A | 11/1994 | Nicholas | |
| 5,374,036 | A | 12/1994 | Rogers et al. | |
| 5,390,465 | A | 2/1995 | Rajecki | |
| 5,394,665 | A | 3/1995 | Johnson | |
| 5,412,919 | A | 5/1995 | Pellock et al. | |
| 5,452,551 | A | 9/1995 | Charland et al. | |
| 5,456,050 | A | 10/1995 | Ward | |
| 5,471,805 | A | 12/1995 | Becker | |
| 5,592,796 | A | 1/1997 | Landers | |
| 5,644,877 | A | 7/1997 | Wood | |
| 5,687,538 | A | 11/1997 | Frobosilo et al. | |
| 5,689,922 | A | 11/1997 | Daudet | |
| 5,755,066 | A | 5/1998 | Becker | |
| 5,787,651 | A | 8/1998 | Horn et al. | |
| 5,797,233 | A | 8/1998 | Hascall | |
| 5,806,261 | A | 9/1998 | Huebner et al. | |
| 5,913,788 | A | 6/1999 | Herren | |
| 5,921,041 | A | 7/1999 | Egri, II | |
| 5,927,041 | A | 7/1999 | Sedlmeier et al. | |
| 5,930,963 | A | 8/1999 | Nichols | |
| 5,950,385 | A | 9/1999 | Herren | |
| 6,058,668 | A | 5/2000 | Herron | |
| 6,176,053 | B1 | 1/2001 | St. Germain | |
| 6,189,277 | B1 | 2/2001 | Boscamp | |
| 6,213,679 | B1 | 4/2001 | Frobosilo et al. | |
| 6,216,404 | B1 | 4/2001 | Vellrath | |
| 6,233,888 | B1 | 5/2001 | Wu | |
| 6,305,133 | B1 | 10/2001 | Cornwall | |
| 6,374,558 | B1 | 4/2002 | Surowiecki | |
| 6,430,881 | B1 | 8/2002 | Daudet et al. | |
| 6,647,691 | B2 | 11/2003 | Becker et al. | |
| 6,732,481 | B2 | 5/2004 | Stahl, Sr. | |
| 6,783,345 | B2 | 8/2004 | Morgan et al. | |
| 6,799,404 | B2 | 10/2004 | Spransy | |
| 6,843,035 | B1 | 1/2005 | Glynn | |
| 6,854,237 | B2 | 2/2005 | Surowiecki | |
| 6,871,470 | B1 | 3/2005 | Stover | |
| 7,152,385 | B2 * | 12/2006 | Morgan et al. | 52/745.05 |
| 7,191,845 | B2 * | 3/2007 | Loar | 169/48 |
| 7,240,905 | B1 | 7/2007 | Stahl | |
| 7,302,776 | B2 * | 12/2007 | Duncan et al. | 52/95 |
| 7,540,118 | B2 * | 6/2009 | Jensen | 52/232 |
| 7,617,643 | B2 | 11/2009 | Pilz et al. | |
| 7,681,365 | B2 | 3/2010 | Klein | |
| 7,752,817 | B2 | 7/2010 | Pilz et al. | |
| 2002/0170249 | A1 | 11/2002 | Yulkowski | |
| 2004/0010998 | A1 | 1/2004 | Turco | |
| 2004/0045234 | A1 | 3/2004 | Morgan et al. | |
| 2004/0211150 | A1 | 10/2004 | Bobenhausen | |
| 2005/0246973 | A1 * | 11/2005 | Jensen | 52/95 |
| 2006/0123723 | A1 | 6/2006 | Weir et al. | |
| 2006/0137293 | A1 | 6/2006 | Klein | |
| 2007/0068101 | A1 | 3/2007 | Weir et al. | |
| 2007/0261343 | A1 | 11/2007 | Stahl, Sr. | |
| 2008/0087366 | A1 | 4/2008 | Yu et al. | |
| 2008/0134589 | A1 | 6/2008 | Abrams et al. | |
| 2008/0172967 | A1 | 7/2008 | Hilburn | |
| 2008/0250738 | A1 | 10/2008 | Howchin | |
| 2009/0038764 | A1 | 2/2009 | Pilz et al. | |
| 2009/0049781 | A1 | 2/2009 | Pilz et al. | |
| 2009/0090074 | A1 | 4/2009 | Klein | |
| 2009/0094912 | A1 | 4/2009 | Klein | |
| 2009/0178363 | A1 | 7/2009 | Pilz et al. | |
| 2009/0178369 | A1 | 7/2009 | Pilz et al. | |

FOREIGN PATENT DOCUMENTS

| | | | |
|---|---|---|---|
| EP | 346126 | A2 * | 12/1989 |
| GB | 2159051 | A * | 11/1985 |
| GB | 2411212 | | 8/2005 |
| JP | 06146433 | | 5/1994 |
| JP | 06220934 | | 8/1994 |
| WO | WO 03/038206 | | 5/2003 |
| WO | WO 2007/103331 | | 9/2007 |

OTHER PUBLICATIONS

DoubleTrack™ information sheets by Dietrich Metal Framing, in 2 pages.

FireStik™ by CEMCO Brochure, published on www.firestik.us_ <http://www.firestik.us>, in 18 pages.

International Search Report for Application No. PCT/US2008/073920, dated Apr. 9, 2009.

Order form from Stockton Products for Soffit Vent / Reveal Screed, in 1 page.

* cited by examiner

FIRE-RATED WALL CONSTRUCTION PRODUCT

RELATED APPLICATIONS

This application is a divisional of U.S. patent application Ser. No. 12/013,361, filed Jan. 11, 2008, now U.S. Pat. No. 7,617,643, which claims benefit under 35 U.S.C. §119(e) to U.S. Provisional Patent Application No. 60/957,434, filed Aug. 22, 2007. Each of U.S. patent application Ser. No. 12/013,361 and U.S. Provisional Patent Application No. 60/957,434 is incorporated in its entirety by reference herein.

BACKGROUND OF THE INVENTION

1. Field of the Invention

This application is directed toward fire-rated wall construction components for use in building construction.

2. Description of the Related Art

Fire-rated wall construction components and assemblies are commonly used in the construction industry. These components and assemblies are aimed at preventing fire, heat, and smoke from leaving one portion of a building or room and entering another, usually through vents, joints in walls, or other openings. The components often incorporate the use of some sort of fire-retardant material which substantially blocks the path of the fire, heat, and smoke for at least some period of time. Intumescent materials work well for this purpose, since they swell and char when exposed to flames, helping to create a barrier to the fire, heat, and smoke.

One example of a fire-rated wall construction component is the Firestik™ design. The Firestik™ design incorporates a metal profile with a layer of intumescent material on its inner surface. The metal profile of the Firestik™ design is independently and rigidly attached to a wall component, such as the bottom of a floor or ceiling, and placed adjacent to other wall components, such as a stud and track. The intumescent material, which is adhered to the inner surface of the metal profile, faces the stud and track, and the space created in between the intumescent material and the stud and track allows for independent vertical movement of the stud in the track when no fire is present.

When temperatures rise, the intumescent material on the Firestik™ product expands rapidly. This expansion creates a barrier which encompasses, or surrounds, the stud and track and substantially prevents fire, heat, and smoke from moving through the spaces around the stud and track and entering an adjacent room for at least some period of time.

While the Firestik™ design serves to prevent fire, heat, and smoke from moving through wall joint openings, it also requires independent attachment and proper spacing from wall components. It would be ideal to have wall components and systems which themselves already incorporate a fire-retardant material.

An additional problem regarding current fire-rated wall components concerns ventilation. Exterior soffits for balconies or walkways are required to be fire rated. However, these soffits need to be vented to prevent the framing members from rotting. The rot is caused when airflow is taken away and condensation forms inside the framing cavity. The moisture from the condensation attacks the framing members and destroys them from the inside out. In many cases, the deterioration is not noticed until the framing is completely destroyed. Therefore, a fire-rated wall component is needed which accommodates proper ventilation during times when no fire or elevated heat is present, and seals itself when fire or elevated heat is present.

SUMMARY OF THE INVENTION

The present invention is directed toward fire-rated wall construction components and systems for use in building construction. The term "wall," as used herein, is a broad term, and is used in accordance with its ordinary meaning. The term includes, but is not limited to, vertical walls, ceilings, and floors. It is an object of the invention to provide wall components and systems which have fire-retardant characteristics. It is also an object of the invention to provide wall components and systems which allow for needed ventilation during times when no fire or elevated heat is present.

To achieve these objects, the present invention takes two separate components, a wall component and intumescent material, and combines the two for use in building construction. The present invention includes at least one surface on a wall component capable of accepting intumescent material. In some embodiments, the outer surface of the intumescent material sits flush with a second surface of the wall component. This allows the wall component to retain its general shape and geometry without creating unwanted edges, protrusions, or uneven shapes. It also removes the need for a separate product or wall component to be installed outside or adjacent to a stud or track.

In an embodiment which resembles a vent or ventilation system, the intumescent material includes a set of holes. The term "holes," as used herein, is a broad term, and is used in accordance with its ordinary meaning. The term includes, but is not limited to, holes, mesh, and slots. When the vent is in use, the combination of the holes in the intumescent material and the holes in the vent surface allow for continuous air flow through the vent. The holes need not match up co-axially, as long as air flow is permitted. In some embodiments, the holes in the intumescent material may line up co-axially with the holes in the vent surface. Additionally, in some embodiments a flat strap sits above the intumescent material. The flat strap may be a discrete piece attached separately, or may already be an integral part of the vent itself. The flat strap has its own set of holes which, when in use, allow for continuous air flow through the vent. In some embodiments the holes may be aligned co-axially with both the holes in the vent surface and the holes in the intumescent material. By having three sets of holes, air can flow through the vent, intumescent material, and strap during times when there is no fire or elevated heat. When the temperature rises, however, the intumescent material will expand quickly and block air pathways. In this manner, the entire vent will be sealed, substantially preventing fire, heat, and smoke from reaching other rooms or parts of the building for at least some period of time.

BRIEF DESCRIPTION OF THE DRAWINGS

These and other features, aspects and advantages of the various devices, systems and methods presented herein are described with reference to drawings of certain embodiments, which are intended to illustrate, but not to limit, such devices, systems, and methods. The drawings include 5 figures. It is to be understood that the attached drawings are for the purpose of illustrating concepts of the embodiments discussed herein and may not be to scale.

DETAILED DESCRIPTION OF THE PREFERRED EMBODIMENT

The present invention is directed toward fire-rated wall construction components and systems for use in building construction. Fire-rated wall construction components and assemblies are commonly used in the construction industry. These components and assemblies are aimed at preventing fire, heat, and smoke from leaving one portion of a building or room and entering another, usually through vents, joints in walls, or other openings. The components and assemblies often incorporate the use of some sort of fire-retardant material, such as intumescent material, which substantially blocks the path of the fire, heat, and smoke for at least some period of time.

Figure 1:
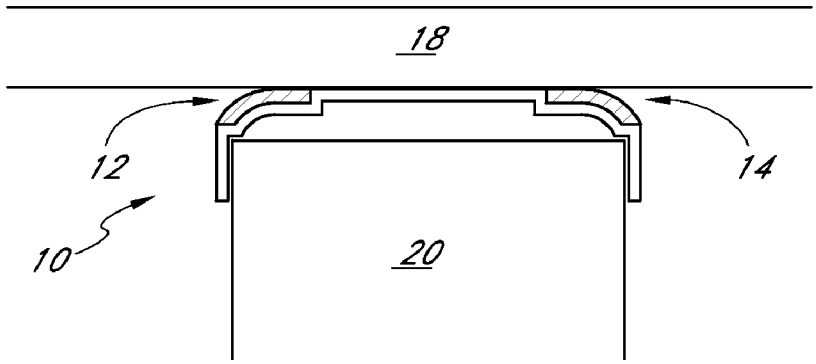
FIG. 1 illustrates a cross-sectional view of an embodiment of a fire-rated wall component connected to a floor and stud element.

FIG. 1 illustrates a cross-sectional view of an embodiment of a fire-rated wall component 10 connected to a floor or ceiling element 18 and stud element 20. The wall component 10 is used as a track for holding a stud within a vertical wall, and may include slots along its sides. The slots provide areas for connection with the studs and allow for vertical movement of the attached studs during an earthquake or some other event where vertical movement of the studs is desired.

Figure 2:
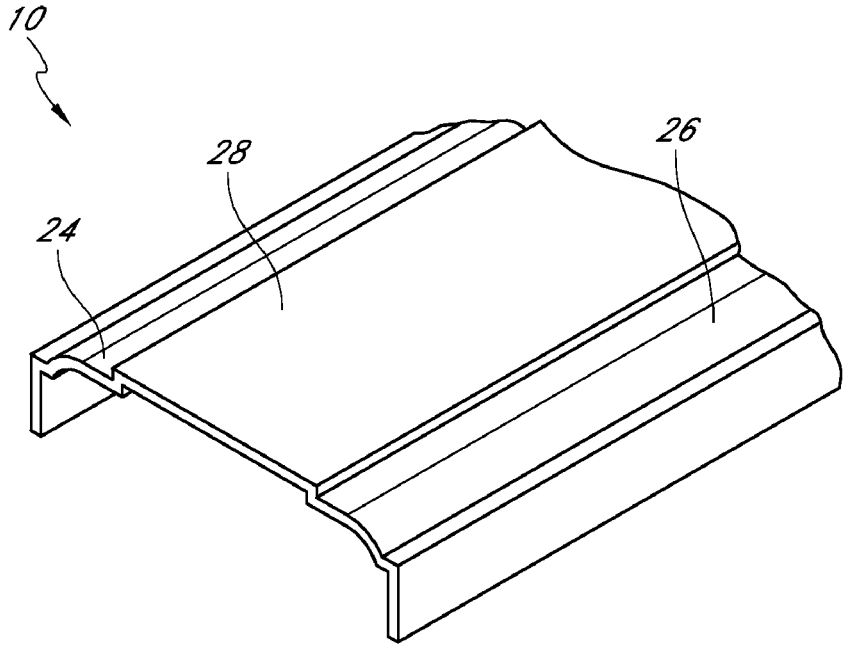
FIG. 2 illustrates a perspective view of an embodiment of a fire-rated wall component with annular portions.
Figure 3:
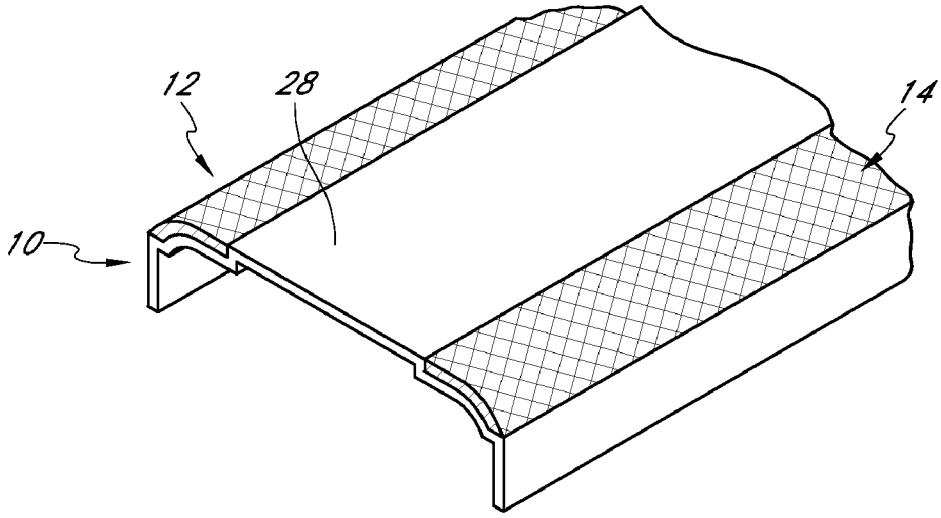
FIG. 3 illustrates a perspective view of an embodiment of a fire-rated wall component with annular portions, including intumescent material.

As can be seen in FIG. 2, wall component 10 has both a flat top surface 28 and two annular surfaces 24 and 26. Top surface 28 is flat for ease of attachment to the bottom surface of a floor or ceiling 18. The two annular surfaces 24 and 26 are designed to receive intumescent material. The intumescent material, identified as 12 and 14 in FIGS. 1 and 3, is bonded to annular surface 24 and 26. The term "bonded," as used herein, is a broad term, and is used in accordance with its ordinary meaning. The term includes, but is not limited to, mechanically bonded or bonded using adhesive. In some embodiments, when the intumescent material is bonded, an outer surface of the intumescent material will be flush with top surface 28. This allows top surface 28 to remain flush, or at least partially flush, with the bottom of floor element 18, and may aid in the installation of wall component 10 to a floor or ceiling. This flush attachment additionally allows the wall component 10 to retain a fluid or smooth-shaped geometry free of added edges, overlaps, or protrusions.

By incorporating intumescent material onto a wall component such as a track for studs in the manner shown, it becomes unnecessary to use or attach additional features or devices to the wall component. Instead, when the temperature rises near the wall component 10, the intumescent material 12 and/or 14 will heat up. At some point when the intumescent material becomes hot enough, it will quickly expand to multiple times its original volume. This intumescent material will expand towards the floor or ceiling element 18 and outwards toward any open space. This helps to substantially prevent fire, heat, and smoke from moving past, through, or around wall component 10 and stud 20 for at least some period of time.

Figure 4:
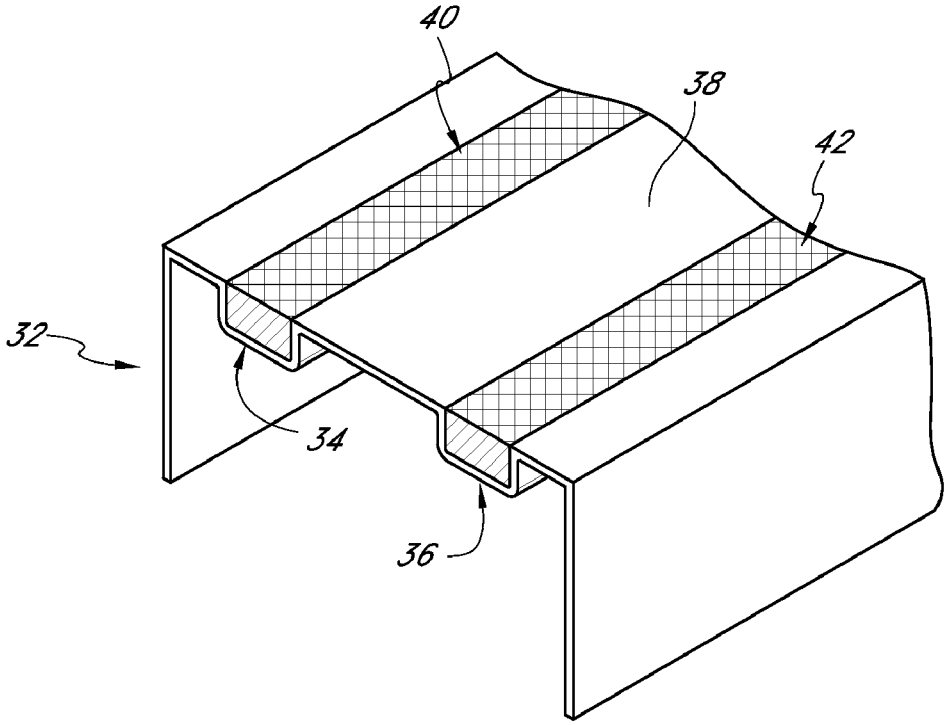
FIG. 4 illustrates a perspective view of an embodiment of a fire-rated wall component with slots and intumescent material in the slots.

FIG. 4 illustrates another embodiment of a fire-rated wall component 32. In this embodiment, the wall component 32 again takes the form of a track member for use in holding studs in place within a vertical wall. However, here the wall component 32 has two slots, shown as 34 and 36, wherein the intumescent material 40 and 42 is attached. As can be seen in the drawing, the top surface layers of intumescent material 40 and 42 are flush with the top surface 38 of wall component 32. This allows the top surface 38 of wall component 32 to maintain a smooth geometry, which may aid in the installation of wall component 32 to a floor, ceiling or intersecting wall. This flush attachment additionally allows the wall component 10 to retain a fluid or smooth-shaped geometry free of added edges, overlaps, or protrusions. However, a flush attachment as described above is not essential to the success of the present invention.

It is possible that more than two slots could be used in the type of embodiment shown in FIG. 4, or even as few as one. The purpose of having the intumescent material located in the slots 34 and 36 is to create fire protection areas. When the intumescent material 40 and 42 becomes hot, it will expand rapidly into the open areas around it. Much as in the embodiment shown in FIGS. 1-3, this expansion will help to create a barrier, or seal, substantially preventing fire, heat, and smoke from moving from one area of a building to another for at least some period of time.

Figure 5A:
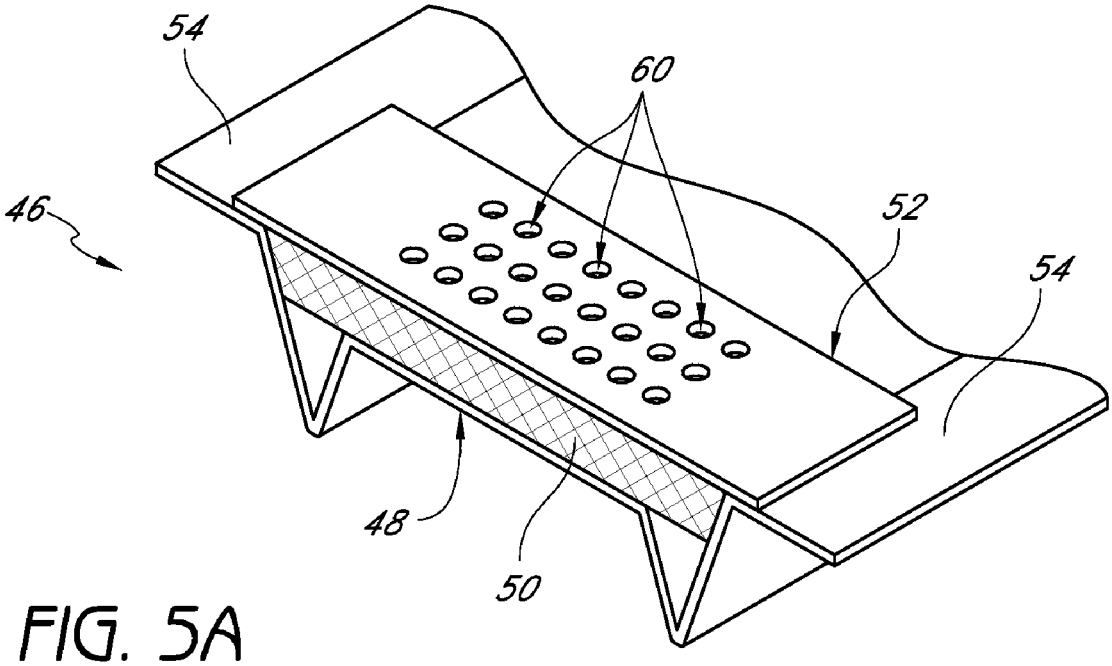
FIGS. 5A and 5B illustrate perspective views of embodiments of a fire-rated wall component including holes for ventilation.
Figure 5B:
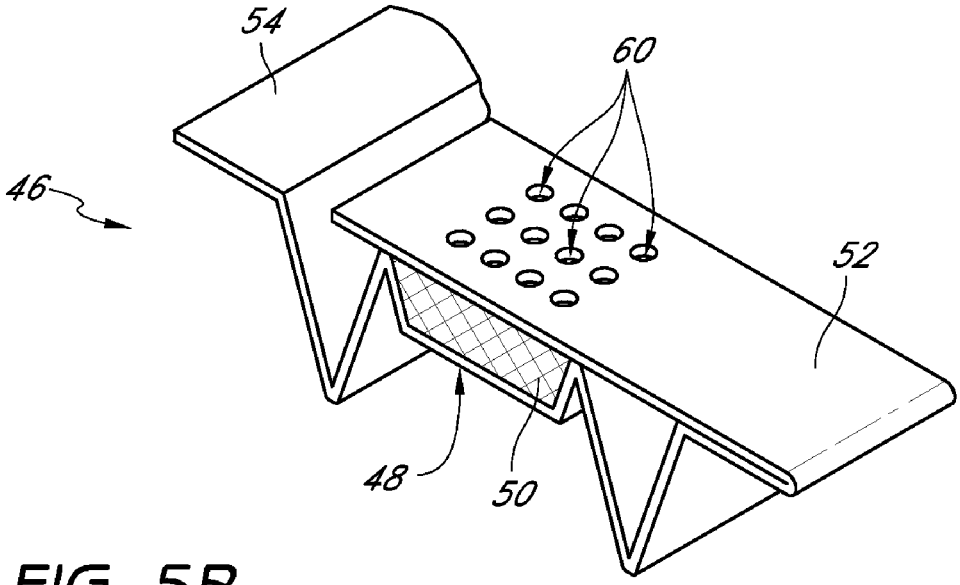
Figure 7:
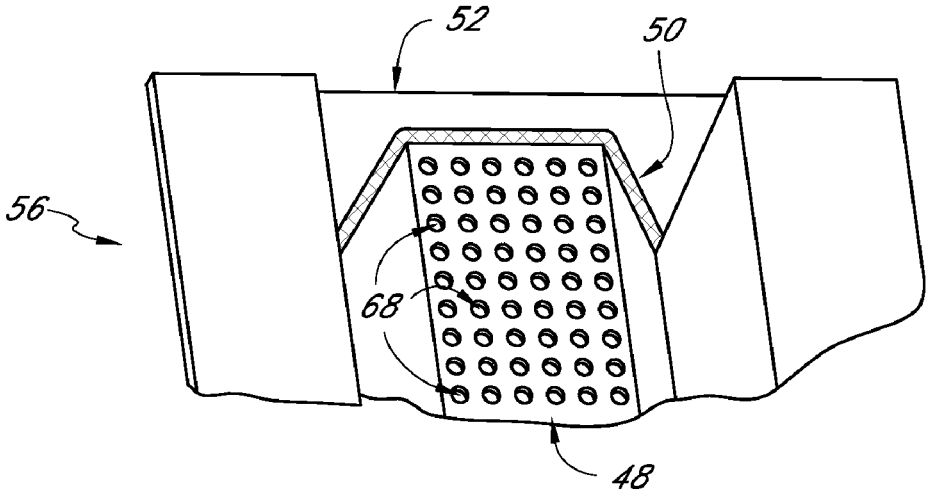
FIG. 7 illustrates a bottom perspective view of an embodiment of a fire-rated wall component including holes for ventilation.

FIGS. 5A and 5B illustrate other embodiments of a fire-rated wall component 46. Here, the wall component takes the form of a vent. The wall component 46 has a lower ventilation area 48 which includes a set or series of ventilation holes. These holes, which are hidden from view in FIGS. 5A and 5B, but are shown in FIG. 7, allow air and other matter to travel between floors and rooms in a building, or between the outside of a building and the interior of a building.

As can be seen in FIG. 5A, a strip of intumescent material 50 is attached adjacent to and above ventilation area 48. The top surface of the intumescent material is flush with the top surface 54 of wall component 46. This allows for easy installation and use of a flat strap 52. A flush fit, however, is not essential to the success of the present invention.

Figure 6:
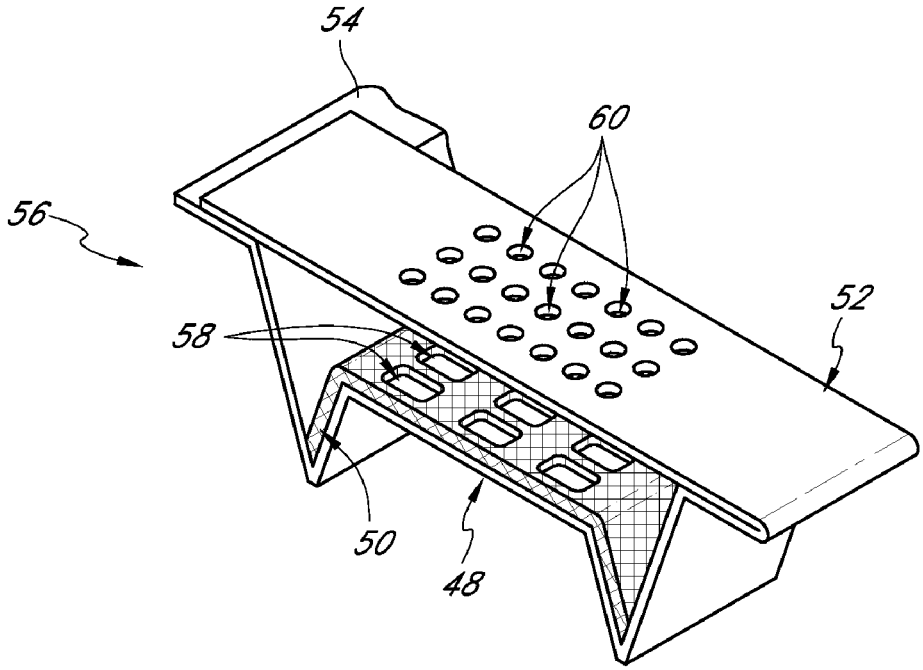
FIG. 6 illustrates a perspective view of an embodiment of a fire-rated wall component including holes for ventilation.

The intumescent material 50 has a series of surfaces defining holes. These holes are hidden from view in FIGS. 5A and 5B but are shown in FIG. 6. The holes allow air and other matter to continue to travel between floors and rooms in a building, or between the outside of a building and the interior of a building. Flat strap 52 also has a series of holes 60 located in its center area. This series of holes, much like the ventilation and intumescent material holes, allows air and other matter to travel between floors and rooms in a building, or between the outside of a building and the interior of a building.

When the intumescent material 50 becomes hot, it will expand rapidly into the open areas around it. Much as in the embodiments shown in FIGS. 1-4, this expansion will help to create a barrier, or seal, substantially preventing fire, heat, and smoke from moving from one area of a building to another for at least some period of time.

FIG. 6 illustrates another embodiment of a fire-rated wall component 56. In this view, intumescent material holes 58 are visible, and the intumescent material 50 extends along the sides of vent area 48. When the intumescent material 50 becomes hot, it expands rapidly, filling much if not all of the space underneath the flat strap 52. This expansion substantially cuts off any air movement through the vent surface 48, and substantially prevents fire, heat, and smoke from moving through the vent for at least some period of time. As can be seen in the embodiment in FIG. 6, the flat strap 52 is formed as an integral part of the wall component 56. In other embodiments, the flat strap 52 may be a discrete piece attached separately.

FIG. 7 illustrates a bottom view of an embodiment of a fire-rated wall component 66. Here, ventilation holes 68 can be seen in the vent area 48. The intumescent material 50 is attached to both the vent area 48 and along its extended sides.

Figure 8:
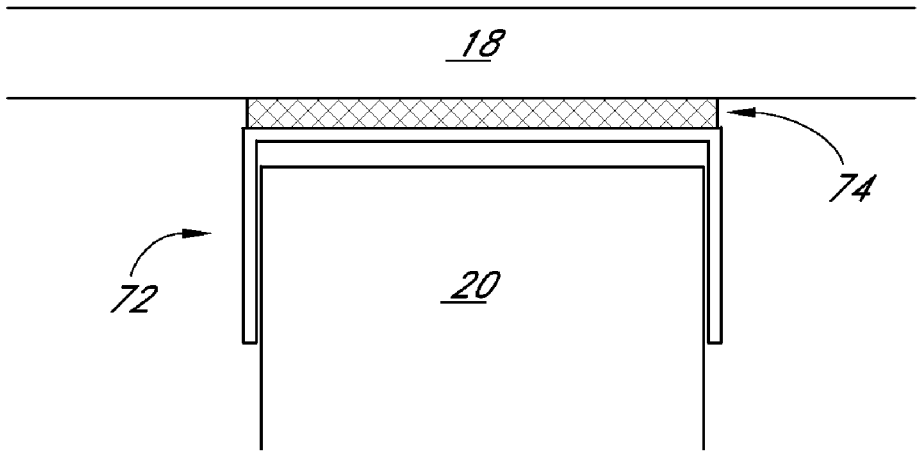
FIG. 8 illustrates a cross-sectional view of an embodiment of a fire-rated wall component with intumescent material on its top surface.

FIG. 8 illustrates another embodiment of a fire-rated wall component 72. In this embodiment, the wall component 72 resembles a simple track for holding a wall stud 20 beneath a ceiling 18. Here, the intumescent material 74 is attached to the top surface of the wall component 72. During installation, it is possible to install the wall component 72 and intumescent material 74 to the ceiling 18. In some embodiments, this may be accomplished by threading a screw through both the wall component and intumescent material. Additionally, in some embodiments the intumescent material may extend down one or both sides of the wall component 72.

Figure 9:
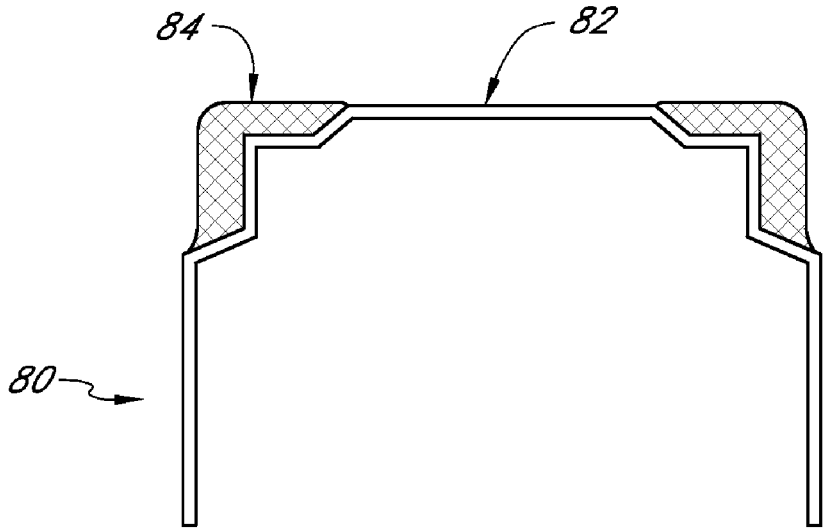
FIG. 9 illustrates a cross-sectional view of an embodiment of a fire-rated wall component with intumescent material on both its top and side surfaces.

FIG. 9 illustrates another embodiment of a fire-rated wall component 80. In this embodiment, the wall component 80 resembles a simple track for holding a wall stud. However, here the intumescent material 84 extends both along a portion of the top and side surfaces of the wall component 80. In some embodiments, an outer surface of the intumescent material 84 may be flush with the top surface 82.

The present application does not seek to limit itself to only those embodiments discussed above. Other embodiments resembling tracks, vents, or other wall components are possible as well. Various geometries and designs may be used in the wall components to accommodate the use of fire-retardant material. Additionally, various materials may be used. The wall component material may comprise steel or some other material having at least some structural capacity. The fire-retardant material may comprise intumescent material or some other material which accomplishes the same purposes as those described above.

What is claimed is:

1. A fire-rated vent for use in a wall assembly comprising:

a lower vent portion comprising an elongate lower wall, the lower wall having first and second flat outer side portions, first and second angled wall portions inward of the first and second flat outer side portions, respectively, and a central ventilation area having a plurality of lower ventilation holes;

an upper vent portion comprising an elongate, flat upper wall having a plurality of upper ventilation holes, the upper vent portion secured to the lower vent portion to define a substantially enclosed space therebetween, wherein the upper ventilation holes and the lower ventilation holes each communicate with the enclosed space; and a strip of fire-retardant material positioned within the enclosed space, the fire-retardant material configured to permit air to move through the enclosed space between the lower ventilation holes and the upper ventilation holes and, in response to elevated heat or fire, expand within the enclosed space and restrict air from moving through the enclosed space between the lower ventilation holes and the upper ventilation holes.

2. The fire-rated vent of claim 1, wherein the upper vent portion is attached to the lower vent portion.

3. The fire-rated vent of claim 1, wherein the upper vent portion is integrally formed with the lower vent portion.

4. The fire-rated vent of claim 3, wherein the upper vent portion is connected to the lower vent portion along an outer edge.

5. The fire-rated vent of claim 1, wherein an air gap exists between the strip of fire-retardant material and the upper wall of the upper vent portion.

6. The fire-rated vent of claim 1, wherein the lower vent portion has a generally W-shaped cross-section.

7. The fire-rated vent of claim 1, wherein the strip of fire-retardant material comprises a plurality of holes passing therethrough to permit air to pass through the strip.

8. The fire-rated vent of claim 1, wherein the upper vent portion contacts both the first and second outer side portions of the lower vent portion.

9. A fire-rated vent for use in a wall assembly comprising:

a lower vent portion comprising an elongate lower wall, the lower wall having an interior surface and an exterior surface, the lower wall having first and second flat outer side portions, the lower wall having a central ventilation area between the first and second flat outer side portions, the central ventilation area being spaced below the first and second flat outer side portions and having a plurality of lower ventilation holes passing through the lower wall;

an upper vent portion comprising an elongate, flat upper wall having an interior surface and an exterior surface, the upper wall having a plurality of upper ventilation holes, the upper vent portion is secured to the lower vent portion to define a substantially enclosed space between the interior surface of the upper wall and the interior surface of the central ventilation area of the lower wall, wherein the upper ventilation holes and the lower ventilation holes each communicate with the enclosed space; and a strip of fire-retardant material positioned within the enclosed space, the fire-retardant material configured to permit air to move through the enclosed space between the lower ventilation holes and the upper ventilation holes and, in response to elevated heat or fire, expand within the enclosed space and restrict air from moving through the enclosed space between the lower ventilation holes and the upper ventilation holes.

10. The fire-rated vent of claim 9, wherein the upper vent portion is attached to the lower vent portion.

11. The fire-rated vent of claim 9, wherein the upper vent portion is integrally formed with the lower vent portion.

12. The fire-rated vent of claim 11, wherein the upper vent portion is connected to the lower vent portion along an outer edge.

13. The fire-rated vent of claim 9, wherein an air gap exists between the strip of fire-retardant material and the upper wall of the upper vent portion.

14. The fire-rated vent of claim 9, wherein the lower vent portion has a generally W-shaped cross-section.

15. The fire-rated vent of claim 9, wherein the strip of fire-retardant material comprises a plurality of holes passing therethrough to permit air to pass through the strip.

16. The fire-rated vent of claim 9, wherein the upper vent portion contacts both the first and second outer side portions of the lower vent portion.

* * * * *